US005804954A

United States Patent [19]

Laplace, Jr.

[11] Patent Number: 5,804,954

[45] Date of Patent: Sep. 8, 1998

[54] ANALOG BASED TAP POSITION DETECTOR

[75] Inventor: Carl J. Laplace, Jr., Raleigh, N.C.

[73] Assignee: Siemens Energy & Automation, Inc., Alpharetta, Ga.

[21] Appl. No.: 494,480

[22] Filed: Jun. 26, 1995

[51] Int. Cl.[6] ..... G05F 1/147

[52] U.S. Cl. ..... 323/256; 323/263

[58] Field of Search ..... 323/256, 257, 323/263, 260, 258, 340, 341, 343; 307/31, 32; 364/483, 492

[56] References Cited

U.S. PATENT DOCUMENTS

| | | | |
|---|---|---|---|
| Re. 29,860 | 12/1978 | Scott | 323/43.5 R |
| 3,622,867 | 11/1971 | Topper et al. | 323/341 |
| 3,678,372 | 7/1972 | Elder | 323/45 |
| 3,721,894 | 3/1973 | Beckwith | 323/20 |
| 4,403,332 | 9/1983 | Weber | 375/94 |
| 4,419,619 | 12/1983 | Jindrick et al. | 323/257 |
| 5,119,012 | 6/1992 | Okamura | 323/258 |
| 5,408,171 | 4/1995 | Eitzmann et al. | 323/258 |
| 5,545,974 | 8/1996 | Trainor et al. | 323/340 |

*Primary Examiner*—Edward Tso
*Assistant Examiner*—Adolf Berhane

[57] ABSTRACT

An tap changer for a voltage regulator including a tap positionable to vary the winding ratio of the transformer in response to changes in an electric load on the transformer is disclosed herein. The transformer includes a potentiometer mechanically coupled to the tap changer motor and immersed in the coolant of the tap changer, wherein the potentiometer generates a voltage representative of the position of the tap. An analog-to-digital conversion circuit converts the voltage to a digital signal representative thereof, and a microprocessor coupled to the analog-to-digital conversion circuit compares the digital signal to digital data representative of the full voltage range of the potentiometer which is correlated to the actual position of the tap.

11 Claims, 2 Drawing Sheets

ANALOG BASED TAP POSITION DETECTOR

FIELD OF THE INVENTION

The present invention relates to an tap changer (e.g. step-type voltage regulator) having a plurality of tap positions selectable to adjust the performance of the transformer based upon the electrical load on the transformer. In particular, the present invention relates to monitoring the tap position and producing a signal representative thereof.

BACKGROUND OF THE INVENTION

In service, a tap changer is supplied with an input voltage and in response thereto produces an output voltage. The purpose of a tap changer (sometimes referred to as a voltage regulator) is to produce an output voltage that is well regulated (i.e., substantially constant at some predetermined target level) despite fluctuations in the input voltage and load from their normal values. An AC voltage regulator for industrial use typically comprises an tap changer having a number of spaced-apart output terminals and performs its regulatory function by adjusting the tap position (in other words, tapping the output terminals at a selected position) so that, for a given input voltage, the output is taken from whichever tap yields an output voltage closest to the target level.

The number of taps provided depends on the environment in which the tap changer is designed to operate and the fineness or resolution with which it is necessary to control the output voltage. One type of tap changer in common use has the equivalent of 33 taps. These taps can be thought of as consisting of a centrally positioned neutral tap, 16 taps on one side of the neutral tap respectively corresponding to excursions of the input voltage of increasing magnitude in one direction from normal, and 16 taps on the opposite side of neutral respectively corresponding to excursions of the input voltage of increasing magnitude in the opposite direction from normal. In practice, such a tap changer has a neutral tap plus first through eighth additional taps and a reversing switch. The tap changer can be placed on the neutral tap to yield an output voltage equal to the input voltage. With the reversing switch in the "raise" position, the tap changer can be placed on the neutral and first taps for a one-raise, entirely on the first tap for a two-raise, on the first and second taps for a three-raise, entirely on the second tap for a four-raise, and so on until the tap changer is entirely on the eighth tap for a sixteen-raise. With the reversing switch in the "lower" position to reverse the current through the coil, the tap changer can be moved in the same way over the same taps to obtain any lower position ranging from a one-lower to a sixteen-lower.

The dynamic range at the input side is typically the normal input voltage plus or minus 10%. When the input voltage is at its normal value, the voltage regulator tap position is normally in neutral and the output voltage of the voltage regulator is equal to the input voltage.

Operators of utility distribution systems employing tap changers need information about tap positions because of its bearing on economy of operation, maintenance, safety, and system performance analysis and control. Consider the matter of economy of operation. Sometimes, because of poor performance and control of a voltage regulator, power is supplied at a voltage which, although not so high as to damage the electrical components that receive power from the tap changer, is higher than the voltage required. In such a case, more power is delivered than is necessary, and the excess power is wasted. In a utility distribution system the waste can be quite substantial.

From the standpoint of maintenance and safety, in certain circumstances it is necessary to move the tap changer quickly and reliably to its neutral position. It is essential that the tap changer position be in neutral whenever the voltage regulator is placed in or removed from service. Information about current tap position is necessary to accomplish this. From the standpoint of system performance and control, a record of successive and present active tap positions of a tap changer is a useful measure of the range and frequency of input voltage excursions and load changes, which are related respectively to the performance of the power supply to the tap changer and to the performance and control of the system to which the tap changer supplies power.

Various kinds of apparatus have been developed in the past for determining the tap position of a tap changer. These prior developments are add-ons to the voltage regulator and have culminated in a common external electromechanical tap position indicator, which is physically attached to the tap changer mechanism and is typically retrofitted. The attached tap position indicator moves with the tap changer mechanism and displays the tap position on a dial or in some other conventional manner.

The standard, conventional electromechanical meter has a number of drawbacks. For one, it has costly moving parts that wear out and is inherently less reliable and more expensive than desirable. Moreover, they frequently produce only a local meter indication, which can be read by an operator only by going to the site of the meter. Furthermore, if meter readings are converted into a signal that can be transmitted to a remote location for reading or to a centrally located computer for processing, such conversion must be performed reliably and cost effectively.

Other prior art relating to the monitoring or determination of the tap position of a tap changer is found in U.S. Pat. Nos. 4,419,619, 4,612,617 and 5,119,012. The devices shown in these patents all have various drawbacks, including relative complexity and a failure to provide certain information or a failure to provide information in a form desired by operators of utility distribution systems incorporating voltage regulators.

In view of the foregoing, it would be desirable to provide a remedy for the problems of the prior art outlined above. In particular, it would be desirable to provide improved monitoring apparatus and methods for use with a tap changer that is integral to the tap changer and reliably and inexpensively keeps track of the tap position as changes occur. Furthermore, it would be desirable to provide monitoring apparatus that provides information on tap position in a form that is convenient and easily accessible either at the tap changer or at a remote location to elevate standards of economy, maintenance, safety, and system performance and control.

SUMMARY OF THE INVENTION

The present invention provides a transformer including a plurality of windings, and a tap which is positioned to change the winding ratio of the transformer. A variable impedance transducer, such as a potentiometer is integral to the tap changer (being disposed therein) and is mechanically coupled to the tap to generate a reference voltage representative of the position of the tap. An analog-to-digital conversion circuit is electrically coupled to the transducer to generate a first binary data signal representative of the voltage across the impedance.

Another configuration of the transformer includes a plurality of windings, and switching means positionable to switch the winding ratio of the transformer. A feedback means generates a voltage representative of the position of the switching means, and a conversion means converts the voltage to a first signal representative of the voltage.

The present invention further provides a method for producing a signal representative of the position of a tap in a transformer of the type including a plurality of windings where the tap is positioned to change the winding ratio of the transformer, where the device producing the signal is disposed within and is integral to the transformer. The method includes the steps of changing the position of the tap to change the winding ratio of the transformer by use of an integral variable transducer, which produces a variable voltage which is representative of the position of the tap. The method also includes the step of converting the voltage to a digital signal representative of the voltage.

BRIEF DESCRIPTION OF THE DRAWINGS

Reference may be now had to the accompanying drawings in which.

DETAILED DESCRIPTION OF THE PREFERRED EMBODIMENT

Figure 1:
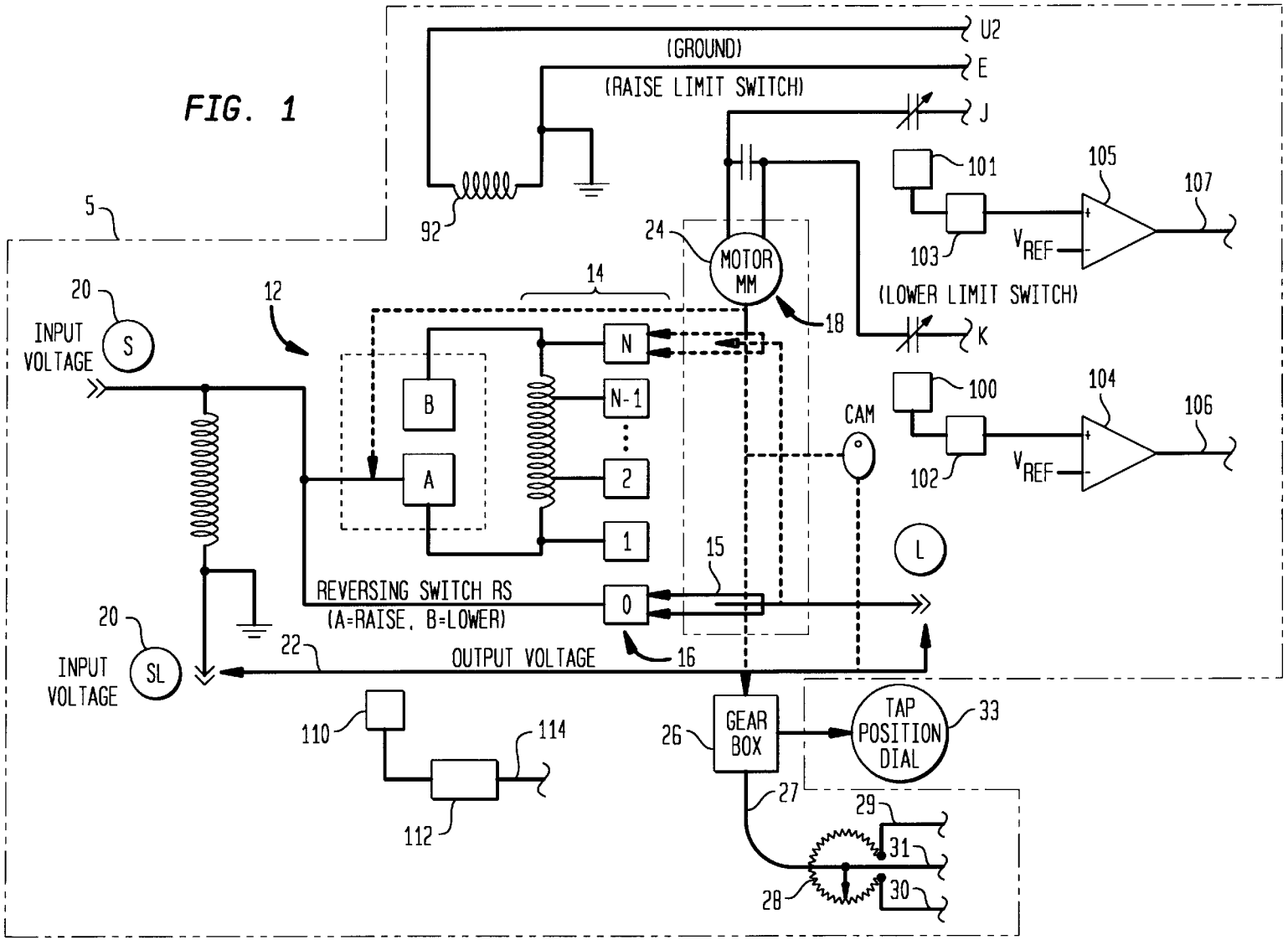
FIG. 1 is a schematic illustration of a transformer and associated tap changer.

Referring to FIG. 1, the tap changer includes a plurality of taps 14 including a neutral tap 0 and taps 1, 2, . . . N−1, N for raising (boosting) or lowering (bucking) the input voltage S. Transformer 12 can be, for example, a Siemens JFR series transformer wherein the transformer is immersed in dielectric coolant contained in a liquid tight housing 5. Transformer 12 also includes an electrically powered tap changer 18 capable of activating any of the taps 0, 1, 2, . . . N−1, N by moving a movable tap 15 into contact with a desired tap 14. If tap 15 is entirely on the neutral tap 0, the output voltage L (22) is equal to the input voltage S (20). If tap 15 is on the 0 and 1 taps, changer 18 produces a one-raise or a one-lower output, depending on whether the reversing switch RS is on terminal A or on terminal B. If the reversing switch RS is on terminal A, it results in a 'raise'; if it is on terminal B, it results in a 'lower' (unless, of course, the tap changer 18 is on the neutral tap 0). The tap changer 18 can thus move tap 15 from the neutral position 0 through a one-raise to a sixteen-raise (with the reversing switch RS on terminal A) or from a one-lower to a sixteen-lower (with the reversing switch on terminal B). If the dynamic range D is plus or minus 10% with respect to the normal input voltage, each step of the tap changer amounts to an adjustment of the output voltage equal to 5/8% (10÷16)% of D/2. A finer adjustment can be obtained by, for example, providing more taps 14.

In the present embodiment, the energy to move tap 15 is generated by a motor drive 24. Drive 24 is mechanically coupled to a gear box 26 which rotates output shaft 27 a desired number of turns (e.g., 1 turn) for each tap 15 change from tap 0 to tap N. Shaft 27 is mechanically coupled (e.g., flexible shaft) to a potentiometer 28 including excitation terminals 29 and 30, and a wiper terminal 31. Potentiometer 28, in the preferred embodiment of the present invention, is operatively connected to output shaft 27 which provides a signal that, as previously mentioned, is indicative of the tap position, as described more fully below. It is wiper terminal 31 which applies a position signal to the digital processing circuit shown generally at 34 (FIG. 2) as described in more detail below. Drive 24 may also be mechanically coupled to a tap position dial 33 which provides a visual indication of the tap position at the exterior of transformer 12.

Transformer 12 is thus adapted to receive an input voltage S on a line 20 and to produce an output voltage L on a line 22 and is constructed so that the output voltage on the line 22 bears a relationship to the input voltage on the line 20 that depends on the activated tap 0, 1, 2, . . . N−1, N. Driver 24 of tap changer 18 is controlled by a controller 34 to activate different ones of taps 14 as necessary to maintain the output voltage close to a target level despite fluctuations of the input voltage or load.

Figure 2:
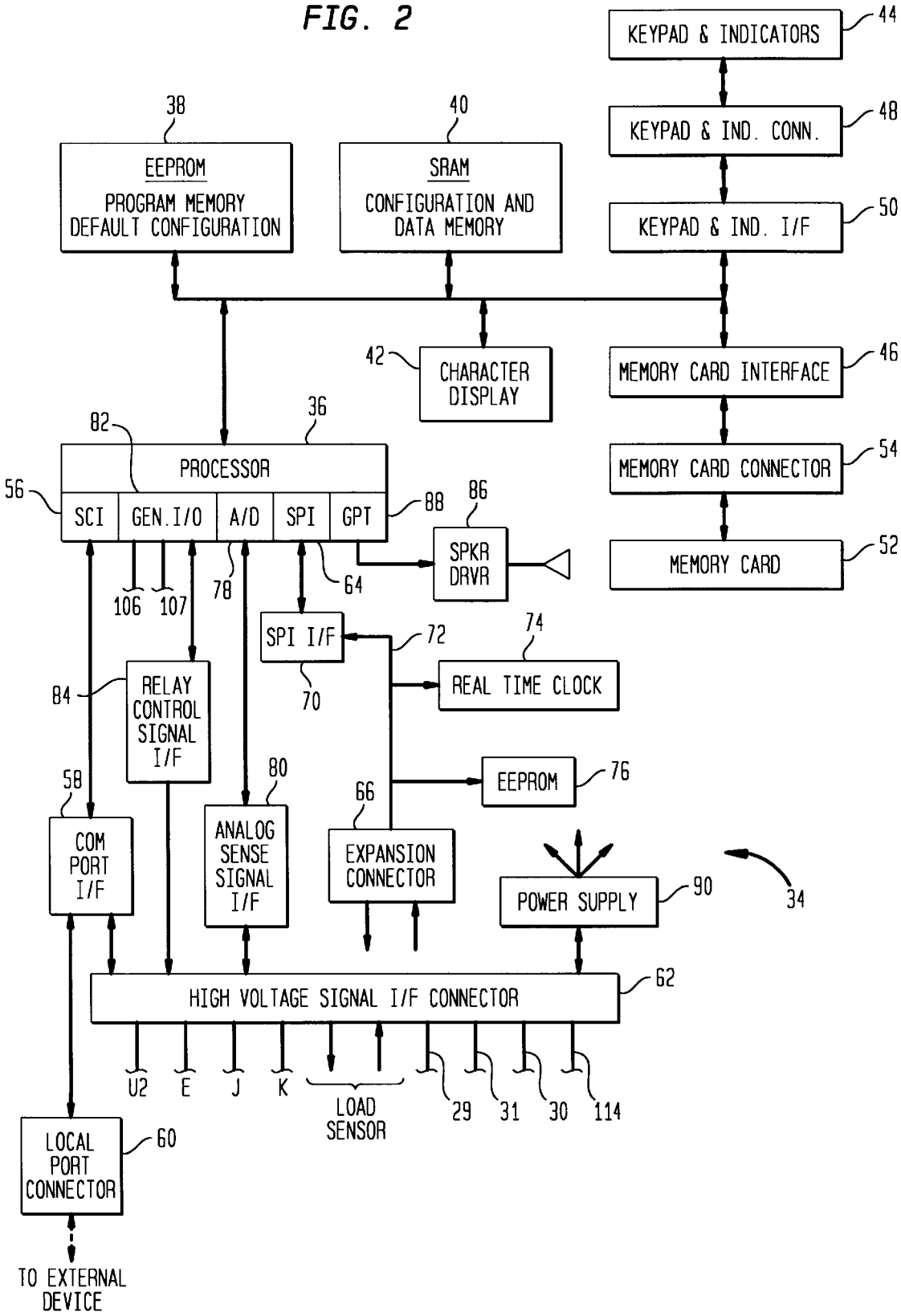
FIG. 2 is schematic diagram of a controller which includes a digital processing circuit which determines the position of the tap in the tap changer.

Referring to FIG. 2, tap changer 18 is coupled to controller 34 by control conductors J and K. Controller 34 includes a digital processing circuit 36 (e.g. Motorola 68HC16 microprocessor), a high voltage interface and connector 62 and a memory card interface 46. Digital data bus 36 couples processor 36 to interface 46.

In general, processor 36 is programmed (configured) to generate digital control signals based on user selected parameters entered via a keypad 44. In operation, transformer 12 operates at relatively high voltages (e.g., thousands of volts). These voltages are monitored by potential transformer 110 (discussed in further detail below) and other internal transformers (not shown) and are provided to the high voltage interface 62. Interface 62, in turn, filters and further scales the signals produced by the internal transformers. The signals produced by interface 62 are applied to an analog-to-digital (A/D) converter 78 which may be integrated in processor 36. A/D converter 78 converts the signals to digital data signals used by the processor 36 to assist in making tap change control decisions and control tap changer 18 based upon such changes.

Memory card interface 46 is disposed in the controller housing (not shown) so that it is accessible from the exterior of the housing. Field changes to the controller's configuration information or the resident memory program of processor 36 can be made by a user plugging a memory card 52 into memory card interface 46 and invoking appropriate commands from keypad 44. Memory card 52 can be left plugged in to collect data or provide a control program, or it can be inserted briefly to transfer information to or from controller 34.

Processor 36 is coupled to the other elements of controller 34 by way of common bus 36. An electrically erasable programmable read only memory (EEPROM) 38 includes the program instructions and default configuration data for processor 36. A static type random access memory (SRAM) 40 stores user programmed configuration data and includes an area for the processor 36 to store working data. Processor 34 is also coupled to alphanumeric character display 42, keypad and indicators 44, and the memory card interface 46 by bus 36. The keypad/indicators 44 are coupled to bus 36 via a connector 48 and a bus interface 50. A memory card 52 can be coupled to the bus 36 by way of an interface 46 (e.g., a conventional PCMCIA interface) and a connector 54.

Operational parameters, setpoints and special functions including metering parameters and local operator interfacing are accessed via the keypad 44. Keypad 44 is preferably of the membrane type; however, any suitable input device can be used. Keypad 44 provides single keystroke access to regularly used functions, plus access (via a menu arrangement) to all of the remaining functions of controller 34.

Processor 36 includes a communications port 56 (e.g., SCI port) which is connected to a communication port interface 58. Interface 58 provides the communications signals to an external local port 60 (accessible on the front panel of controller 34). An isolated power supply for the communication port interface 58 is provided by a high voltage interface via a high voltage signal interface connector 62.

The communication port interface 58 supports bi-directional data transfer which allows controller 34 to be configured for tap changer control purposes via a serial link, providing meter, status information, tap position and other data to remote devices. In addition to supporting the configuration and data retrieval functions for remote access, the communication port interface 58 supports unloading and/or downloading the program code for the processor 36.

Processor 36 also includes an SPI port 64 which is connected to an expansion connector 66 by way of an SPI interface 70. The expansion connector 66 provides access to bus 72. Other devices that reside on SPI bus 72 include a real time clock (RTC) 74 and a serial EEPROM 76. Serial EEPROM 76 stores user programmed configuration data. The user programmed configuration data is downloaded to the SRAM 40 by the processor 36 upon initialization. The SRAM 40 copy of the user programmed configuration is used as the working copy of the configuration data. Whenever a configuration change is made, the new information is stored in both SRAM 40 and in serial EEPROM memory 76. Clock 74 is programmed and read by the processor 34.

Scaled analog signals from the high voltage signal interface connector 62 are provided to A/D converter 78 by way of an analog sense signal interface 80. Interface 80 low pass filters the scaled analog input signals prior to application to A/D converter 78. More specifically, analog signals representative of the load on transformer 12 are applied to converter 78 via interface 80. Additionally, interface 80 applies an excitation signal (e.g., 5 volts) to leads 29 and 30 of potentiometer 28, and applies the wiper voltage at lead 31 to A/D 78.

Control signals from the general I/O port 82 of processor 36 are provided to the high voltage signal interface connector 62 by way of a relay control signal interface 84. Interface 84 converts the voltage levels of I/O port 82 control signals to voltage levels which can operate motor drive 24 of tap changer 18. A speaker driver 86 is connected to the General Purpose Timer (GPT) port 88 of the processor 36. Processor 36 also includes a power supply 90 which provides regulated power to each of the circuit elements of FIG. 2 as needed. Connector 62 provides an unregulated and unrectified power supply via conductors U2 and E from a power winding 92 in transformer 12. The power from winding 92 is rectified and regulated to 5 volts DC by supply 90.

Turning now to the operation of potentiometer 28, potentiometer 28 provides a variable impedance transducer mechanically coupled to tap 15 to generate an impedance representative of the position of tap 15. More specifically, as wiper 31 of potentiometer 28 moves, the impedance (resistance) measured at wiper 31 changes, and the voltage applied to A/D 78 changes. Potentiometer 28 and gear box 26 are preferably selected so that the ratio of the voltage at lead 31 and the excitation (reference) voltage across leads 29 and 30 is proportional to tap 15 position.

In the preferred embodiment of the present invention, potentiometer 28 although disposed the within transformer housing 5, is in the upper part of the housing, preferably adjacent tap position dial 33, above the compartment containing dielectric oil.

Further, since potentiometer 28 is integral to and disposed within the transformer housing 5 in another embodiment of the present invention, potentiometer 28 may be immersed directly into the coolant (not shown) contained within the transformer housing 5. This coolant, as is known to one skilled in the art is typically a dielectric oil and is used to extend the life of the transformer windings by controlling the winding temperature. Therefore, by immersing potentiometer 28 in the same coolant as the transformer, potentiometer 28 is assured of operating within a known and controllable temperature range, thereby minimizing or eliminating the chance for impedance changes relating to temperature swings should the ration of the voltage at lead 31 mentioned above not be proportional. Moveover, the coolant also keeps potentiometer 28 clean and free from debris during operation as well as protecting it from the elements.

Thereafter, A/D 78 converts the excitation and wiper voltages to binary (digital) values which are compared by processor 36 to determine tap position. Accordingly, a plurality of values over time provides a digital data signal which processor 36 continuously compares to the digital values representative of the excitation voltage.

Alternatively, rather than attempting to configure the system so that the voltage at lead 31 is proportional to tap 15 position, a lookup table could be stored in EEPROM 38. The table would include the tap 15 positions and associated binary values representative of the voltages produced at lead 31 at each tap 15 position. By way of other alternatives, potentiometer 28 could be replaced with a linear device which changes impedance upon movement of tap 15 along taps 14, and/or a differential transformer (e.g. LVDT) could be used instead of a potentiometer. Of course, the circuitry associated with potentiometer 28 would be modified if a differential transformer were used.

Accordingly, based upon the signals applied to processor 36 by A/D 78 representative of the excitation and wiper voltages, processor 36 generates a binary data signal representative of the position of tap 15. Processor 36 can also be configured (programmed) to apply the data signal to SCI port 56 which applies a binary data communications signal to communications port interface 58. Furthermore, processor 36 can convert the data signal representative of tap position to display signals which processor 36 applies to character display 42 via databus 36 to generate a visual indication thereon of tap 15 position.

The preferred embodiment of the invention has been described in detail herein, and various modifications, enhancements and improvements which do not depart from the scope and spirit of the invention will become apparent to those of skill in the art. Thus, it should be understood that the preferred embodiment has been provided by way of example and not by way of limitation. The scope of the invention is defined by the appended claims.

What is claimed is:

1. A transformer comprising:

a liquid tight housing;

a plurality of windings contained within said housing and comprising a plurality of taps, each winding being connected to a respective tap, said plurality of windings having a first winding and a last winding;

a movable tap contained in said housing which can be positioned to change the winding ratio of the transformer; and a variable impedance transducer contained in said housing and being mechanically coupled to the movable tap for producing a position signal relative to a reference signal such that said position signal is representative of the position of said movable tap with respect to the position of the first winding and the last winding.

2. The transformer of claim 1, further comprising an analog-to-digital conversion circuit electrically coupled to said transducer for generating a first binary data signal representative of said position signal.

3. The transformer of claim 2, further comprising a digital processing circuit coupled to the conversion circuit, the conversion circuit also generating a second binary data signal representative of the value of said reference signal, and the digital processing circuit comparing the first and second binary data signals to generate a third binary data signal representative of said position of said movable tap.

4. The transformer of claim 3, wherein the digital processing circuit comprises a digital data memory and a microprocessor coupled to a communications output to apply a communications signal representative of the third binary data signal to the communications output.

5. The transformer of claim 1, wherein said transducer is a potentiometer.

6. The transformer of claim 4, wherein said transducer is a potentiometer.

7. The transformer of claim 1, further comprising:

rigid shaft mechanically coupled to said movable tap; and a flexible shaft mechanically coupled between the rigid shaft and said transducer.

8. The transformer of claim 4, further comprising:

a rigid shaft mechanically coupled to said movable tap; and a flexible shaft mechanically coupled between the rigid shaft and said transducer.

9. The transformer of claim 1, further comprising a tap position indicator external to said housing, said tap position indicator mechanically coupled to said movable tap.

10. The transformer of claim 4, further comprising a tap position indicator external to said housing, said tap position indicator mechanically coupled to said movable tap.

11. The transformer of claim 1 wherein said liquid tight housing has dielectric oil contained therein, and wherein said variable impedance transducer is immersed in said dielectric oil.

* * * * *